US007469165B2

(12) United States Patent
Mataya

(10) Patent No.: US 7,469,165 B2
(45) Date of Patent: Dec. 23, 2008

(54) MACHINED PART AND METHOD OF MANUFACTURE

(75) Inventor: Robert F. Mataya, Nixa, MO (US)

(73) Assignee: Tracker Marine L.L.C., Springfield, MO (US)

( * ) Notice: Subject to any disclaimer, the term of this patent is extended or adjusted under 35 U.S.C. 154(b) by 1 day.

(21) Appl. No.: 11/459,766

(22) Filed: Jul. 25, 2006

(65) Prior Publication Data

US 2007/0073435 A1 Mar. 29, 2007

Related U.S. Application Data

(60) Provisional application No. 60/596,449, filed on Sep. 23, 2005.

(51) Int. Cl.
*G06F 19/00* (2006.01)

(52) U.S. Cl. ..... 700/159; 361/234

(58) Field of Classification Search ..... 700/147, 700/159, 182, 247, 197; 264/113, 219, 511; 425/219; 361/234; 279/128
See application file for complete search history.

(56) References Cited

U.S. PATENT DOCUMENTS 5,113,338 A * 5/1992 Seki et al. ..... 700/86
5,702,663 A * 12/1997 Seemann ..... 264/510
2002/0176219 A1* 11/2002 Sakaue et al. ..... 361/234
2003/0000298 A1* 1/2003 Heisler et al. ..... 73/147
2003/0050726 A1* 3/2003 Jaffrey ..... 700/182
2003/0122285 A1* 7/2003 Crane et al. ..... 264/511
2005/0112397 A1* 5/2005 Rolfe et al. ..... 428/593
2007/0013724 A1* 1/2007 Swift ..... 345/660
2007/0026201 A1* 2/2007 Botrie et al. ..... 428/195.1

OTHER PUBLICATIONS

Kleineberg et al., Cost Effective CFRP-Fuselage Manufacturing with Liquid resin Infuse (LRI) -Technologes, DLR institute of Structural Mechanics, p. 1-10.*

* cited by examiner

*Primary Examiner*—Kidest Bahta
(74) *Attorney, Agent, or Firm*—Husch Blackwell Sanders LLP

(57) ABSTRACT

A machined part is provided. The machined part is formed from a porous substrate material that is machined to shape. After machining to shape, a resin is infused into the machined part precursor to a layer thickness depending on the end use of the finished part. The resin is then allowed to harden to complete the part. The finished part may be used as a prototype tool, a tool for forming other tools such as mold parts and finished tooling.

16 Claims, 2 Drawing Sheets

MACHINED PART AND METHOD OF MANUFACTURE

CROSS REFERENCE TO RELATED APPLICATION

This Application claims the benefit of U.S. Provisional Application Ser. No. 60/596,449 filed Sep. 23, 2005, of the same title, said application the entire disclosures of which is incorporated herein by reference.

BACKGROUND OF INVENTION

The present invention relates to a method of machining parts using CNC (computerized numerical control) machinery and techniques.

Parts are machined using CNC techniques and machinery. CNC techniques and machinery are well known. The structural and shape details of the part to be formed are programmed into a computer which operates various components of a CNC machining apparatus. Following the programmed design criteria, the CNC machining apparatus will machine a part to size and shape. Typically, this will involve the use of multiple cutting tools or devices following various programmed cutting tracks which may be straight, stepped, curved, compound and the like. Reference points are provided for the CNC machining apparatus components to orient and position themselves during cutting tool changes and machining track changes.

CNC machining is commonly used to form patterns, tools, prototype parts and production parts out of various materials that are dimensionally stable enough to be machined with a desired degree of accuracy and finish. However, the formed part is as it is finished, with the properties of the machine formed part the same as those of the starting material. Additional finishing steps may be performed later, e.g., polishing and heat treating. Thus, if a highly durable end product is needed, the starting material needs to be highly durable. This increases the expense of the machined part typically because higher density, harder more durable materials increases the material and machining costs. It would be desirable, to provide a method of forming a CNC formed part which would allow subsequent changing of the properties of the formed part in an easy manner to provide increased durability on at least the machined and exposed part surface but allow the use of a cost effective substrate material which often times is easier to machine to shape. However, the resulting end product should be predictably dimensioned to the desired dimensions and tolerances.

The prior art process of forming pattern parts using CNC machining typically includes part design, creating machining instructions, pattern cutting or fabrication, pattern surface preparation for tool construction, and prototype or production tool fabrication of a pattern surface. When the pattern material used is of a very low density it is not uncommon to destroy or damage the pattern during the fabrication of a single production tool, e.g., a mold component. When that happens, and more production tools are needed, a master tool is fabricated from the original production tool and subsequent production tools are built off the master tool. Such a process is time consuming and expensive. The present invention provides an improvement to this process and produces a durable tool or part that can be used as an end part or a pattern which has increased durability utilizing a relatively inexpensive easy to machine and porous substrate.

The present invention provides such a process and resulting end product.

SUMMARY OF THE INVENTION

The present invention involves the provision of a method of making a machined part from a low density, porous material having increased strength and durability. The method involves the securing of a blank of material in place on a computer controlled machining apparatus and machining the blank of material to a part precursor with a finished shape that one has provided for in the instructions to the machining apparatus. The precursor to the final part is then infused with a hardenable liquid to a desired depth from the exposed working surface inwardly. The infused liquid is allowed to harden to form a relatively rigid surface layer after infusion on at least a portion of the machined surface of the part precursor. The part may then be used as a tool for such things as a pattern for making parts such as a mold component or as a mold component, e.g., a boat mold component, having increased durability and strength over that of the machined blank prior to infusion and hardening of the infusion liquid.

The present invention also involves the provision of a machined part having a substrate that is machined to shape from a blank of material wherein at least a portion of an exterior zone of the machined part is porous and infusible with a liquid. The liquid is infused into interstitial spaces in the machined blank. The infused liquid is allowed to harden to provide an exterior surface and underlying layer that is relatively hard and durable as compared to the substrate. The liquid is infused at least a few thousandths of an inch into the part precursor (the machined blank) and may be infused throughout the entirety of the part precursor depending upon the final product properties needed.

DETAILED DESCRIPTION

Figure 1:
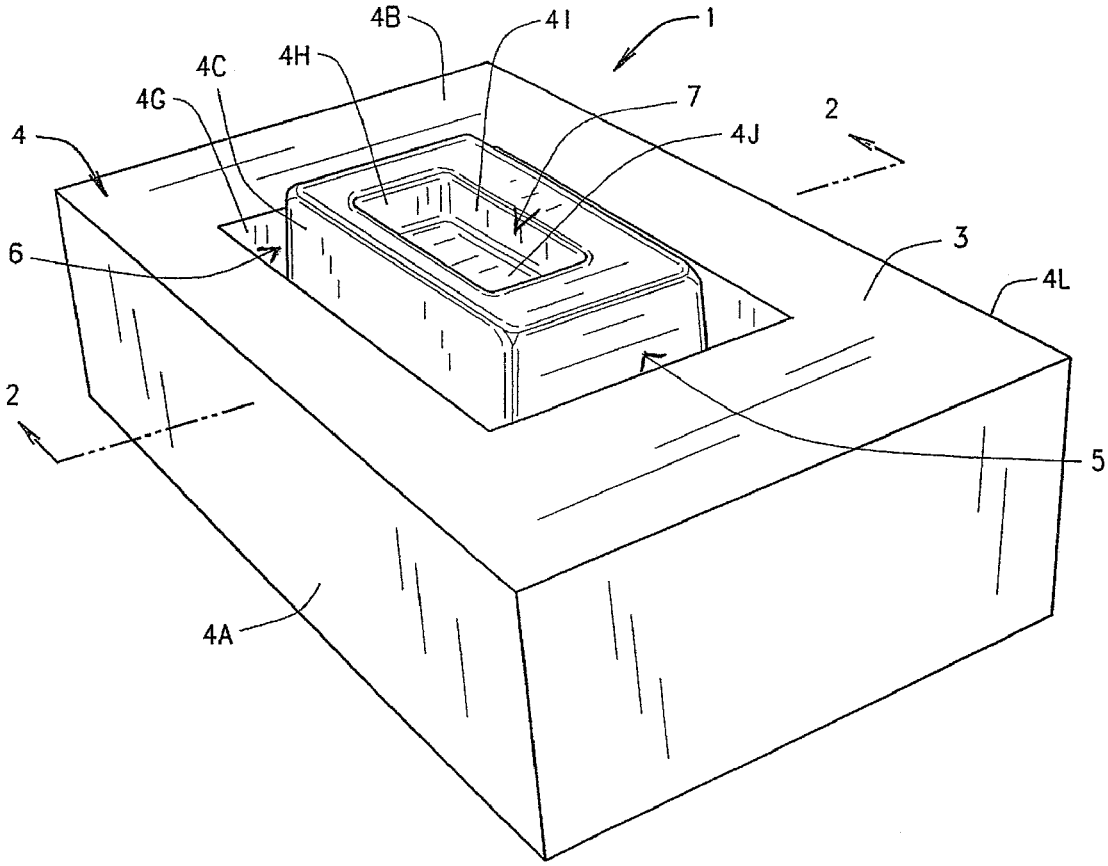
FIG. 1 is a perspective view of a CNC formed part.
Figure 2:
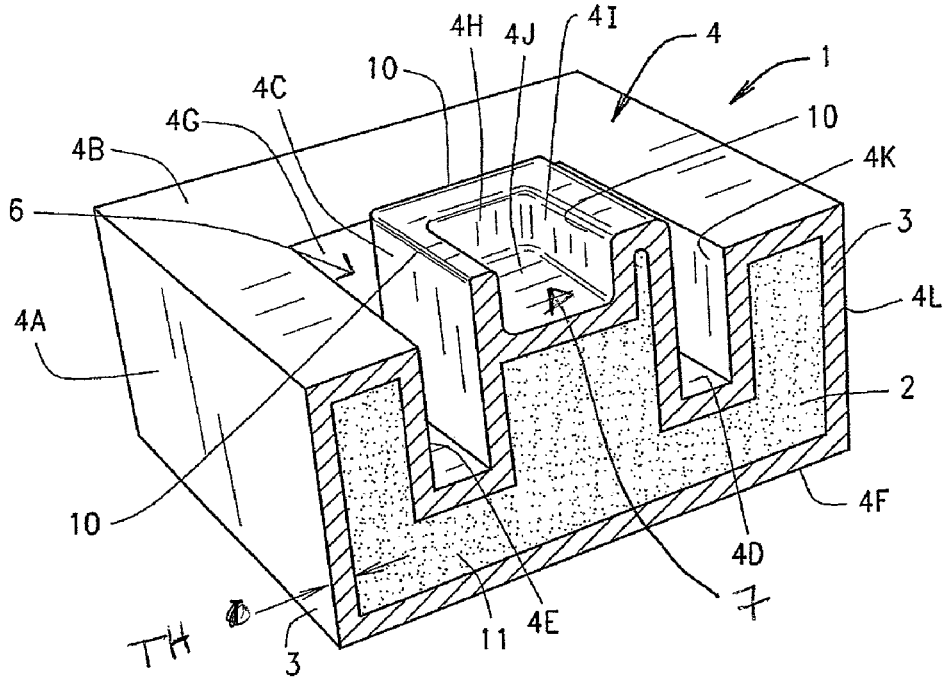
FIG. 2 is a cross section view of the part shown in FIG. 1 taken along the line 2-2.
Figure 3:
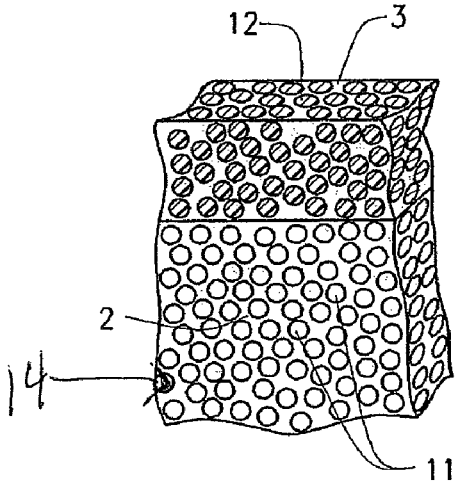
FIG. 3 is an enlarged fragmentary sectional schematic representation of a portion of an infused part with details exaggerated for clarity.
Figure 4:
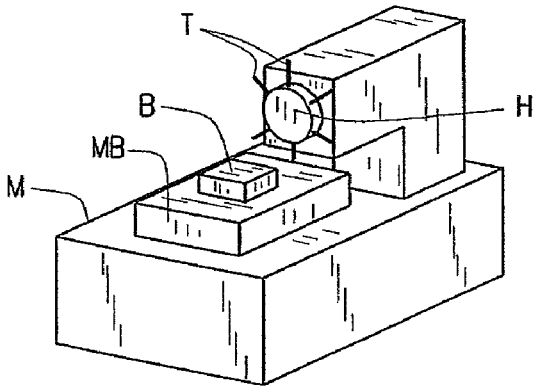
FIG. 4 is a schematic perspective view of a CNC machining apparatus.

The reference numeral 1 designates generally a machined and treated part with its contour formed on a machining apparatus, e.g., a CNC machine. The precursor to the final part 1 is a three dimensional blank B that is machined to any suitable shape, size and contour and as shown includes a core 2 with an infused exterior skin, casing layer or zone 3 herein referred to as layer 3 for brevity. In the formation of the part 1, a CNC machine M through its programming, will machine the exterior shape and sometimes even an interior shape with exposed surfaces, e.g., bored holes forming an exposed tool working surface 4 with one or more surface components 4A-L. The machining apparatus M (FIG. 4) may utilize various machining steps, machine cutting tools T, for example, round or flat bottomed end mills, drill bits, and/or laser as desired for the particular surface contours and dimensions to be formed as is known in the art. For example, a flat bottom straight end mill may be utilized to machine the grooves 5 and 6 and a tapered end mill can be utilized to form the pocket 7 and a radiused cutter can be used to form the radiused corners 10. The exterior surfaces 4A, 4L may be formed with one or more suitable cutting tools, for example, e.g., a side cutting tool and an end mill. The part 1 is usually fixed in position on the machining apparatus M on a movable bed MB and the bed and/or cutting tools T can be moved relative to one another during the various cutting or forming steps. Alternatively, the bed may be stationary and the cutting head H could be moved to effect the machining. The drive system for the tool carrying head H is programmed for movement in combination with movement of the bed MB, if the bed MB is movable, to effect cutting along one or more pre-determined cutting paths or tracks.

Typically, the material or materials of the blank or pre-form B is/are selected for forming the part 1 so that a complete machined part precursor with an exposed working or tool surface 4 is provided at the end of the machining step(s). The blank B may be preformed to a rough shape to reduce the amount of material to be removed. The appropriate material to be machined to form the part precursor will have selected inherent or native physical properties such as density, hardness, wear resistance, toughness, strength and the like and will be porous to hardenable liquid infusion resin. Preferred materials for the blank have a porosity in the range of between about 40% and about 90% by volume of the blank B. The pores 11 in a blank are sized to allow the resin 12 to flow thereinto by capillary flow and/or pressure differential induced flow to provide the desired thickness TH for the infused layer 3. The exposed ends 14 of the pores 11 are sized large enough to permit infusion of liquid resin and small enough to provide a finished surface that approximates the machined contour as if the pores were not present. Leveling characteristics and surface tension of the liquid resin can be selected to provide a substantially uninterrupted working surface 4. If the infusion resin 12 builds up a surface coat to change the dimensions of the machined precursor the precursor can be machined smaller to compensate. Fiberboard with a density in the range of between about 10 lb/ft$^3$ and about 30 lb/ft$^3$ has been found acceptable to produce a part precursor and final part 1.

With the practice of the present invention, fiberboard is a preferred porous material. Fiberboard is relatively inexpensive, easy to machine and will hold its machined shape during storage. However, fiberboard has a relatively soft surface which can be abraded, dented or the like. The present invention involves the infusion of a hardenable liquid resin 12 into the machined precursor of finished part 1 forming the surface skin or casing portion 3 extending inwardly from the formed surface 4 such that the resin hardens, as for example by curing, into a harder more durable surface 4, layer 3 and thus part 1. The infusion may be effected or assisted by vacuum infusion which can be utilized to induce flow of, e.g., a thermosetting resin into the outer portion of the precursor to part 1. The depth of infusion can be selected for the particular end product and its applications. The proper selection of the resin and its hardening process can be tailored to the end application of the part 1. Such things as resin viscosity and/or surface tension, infusion time, vacuum level (or pressure differential level), porosity can be adjusted and/or selected to meet the end use specifications of the part 1 and properties needed for the working surface 4. The depth of penetration of the resin and hence skin or casing layer 3 thickness can be controlled during the infusion process as desired. The thus infused precursor to finished part 1 may be further processed to effect hardening of the resin, for example, by heat curing, catalytic curing as for example, an epoxy resin system, or chemical curing as desired. The thickness of the skin or casing layer 3 infused surface portion can be thin, on the order of a few thousandths of an inch, e.g., about 0.020 inches to thicknesses up to several inches or the entirety of the part 1 may be infused. Preferably, the layer 3 is at least about ⅛ inch thick. For boat mold forming patterns, thickness in the range of between about 0.125" and about 0.75" are acceptable, but depend somewhat on the size of the patterns. The entirety of the part 1 may be infused if desired or selected zones may be infused or infused differentially. The part 1 may be finished, e.g., by polishing or controlled abrasion of the exterior, to provide the appropriate or desired surface finish, e.g., a matte finish or a high gloss finish. Polishing or abrasion can be used to reduce any surface imperfections resulting from the machining or infusion process. Abrasion can be used to, e.g., provide a mat finish.

The infused layer 3 in the part 1 precursor is preferably non-porous and forms a barrier between the surface 4 of the part 1 and any uninfused portion of the part 1 inside of the layer 3. By being impervious, it is meant that the layer is continuous or has pores so small that additional liquid will not infuse through the layer 3 or substantially into the layer 3 if other liquids are applied to that layer during subsequent use of the finished part 1.

The part 1 may be used as a mold forming tool for forming permanent or semi-permanent mold parts such as male and female rigid, semi-ridged and/or flexible mold components or halves, as a tool for forming additional similar parts, or as a prototype mold or even as a limited use production mold component and a male or female mold component. The density and hence porosity of the blank used to make part 1 may be selected depending upon the end use of the finished part 1. The resin used to infuse the precursor to the finished part 1, may also be selected based on the type of end use to which the finished part 1 is to be used. Such resins include polyester, epoxy or similar materials.

It is seen that the invention eliminates much of the time and expense in traditional CNC formation of parts and simplifies the part production process by permitting the elimination of certain part formation steps. The process of the present invention includes the design of the part, providing of the appropriate machining data to the machining apparatus M, forming the part 1 precursor on the machine M by utilizing appropriate cutting devices, which can also include laser cutting devices as well as typical mechanical type cutters. After forming of the precursor to the finished part 1, at least a skin or layer 3 is infused with a resin and hardened to the desired degree. Infusion resin may be applied by dipping, submersion, spraying with or without vacuum assist. Capillary action for infusion may be adequate on its own. The present invention allows the formation of a finished part 1 utilizing a porous fiberboard material which typically is cellulose based.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations, and other uses and applications of the present construction will, however, become apparent to those skilled in the art after considering the specification and the accompanying drawings

The invention claimed is:

1. A method of forming a part using CNC machining, said method including:

securing a blank of material in place for machining on a machining apparatus, said material being porous;

providing machining instructions to the machining apparatus;

machining a part precursor from the blank of material in accordance with the machining instructions to form a machined surface;

infusing at least a portion of an exterior portion of the machined part precursor with a hardenable liquid; and hardening the infused liquid to form a rigidified infused zone inwardly from the machined surface to produce a finished part consisting of one of a mold component and a pattern for boat manufacture with an exposed tool working surface.

2. The method of claim 1 wherein the blank of material includes cellulosic material.

3. The method of claim 2 wherein the cellulosic material includes fiberboard.

4. The method of claim 3 wherein at least a portion of the infused zone is at least about ⅛inch thick.

5. The method of claim 1 wherein the infusing includes flow by capillary action.

6. The method of claim 1 wherein the infusing includes the application of vacuum or pressure to the final part precursor.

7. The method of claim 1 wherein the blank of material has at least about 40% interstitial space therein capable of receiving and retaining the liquid.

8. The method of claim 1 wherein the liquid is hardened by curing.

9. The method of claim 1 wherein the liquid includes epoxy.

10. The method of claim 1 wherein the liquid includes thermosetting resin.

11. The method of claim 1 wherein the infused zone is at least about 0.125 inches thick.

12. The method of claim 11 wherein the infused zone has a thickness in a range of between about 0.125 and about 0.75 inches.

13. The method of claim 1 including using the finished part as a pattern for manufacturing a boat component.

14. The method of claim 13 including-using the finished part as a mold component.

15. The method of claim 14 including using the mold component to form at least a portion of a boat.

16. The method of claim 15 including forming a molded boat component using the finished part as a mold component.

* * * * *